US005755336A

United States Patent [19]

Rudy

[11] Patent Number: 5,755,336

[45] Date of Patent: May 26, 1998

[54] OPTICAL SORTER, TRACKER AND READER

[75] Inventor: Manfred Rudy, Kennesaw, Ga.

[73] Assignee: Nale, Inc., Kennesaw, Ga.

[21] Appl. No.: 434,247

[22] Filed: May 3, 1995

[51] Int. Cl.[6] ..... B07C 5/02; B65H 9/16

[52] U.S. Cl. ..... 209/539; 209/583; 209/657; 209/900; 271/122; 271/251; 198/367.1; 198/370.01

[58] Field of Search ..... 209/539, 552, 209/559, 562, 564, 567, 569, 576, 577, 583, 584, 587, 657, 900, 938; 271/10.07, 10.08, 251, 121, 122; 198/460.1, 370.01, 367, 367.1

[56] References Cited

U.S. PATENT DOCUMENTS

| | | | |
|---|---|---|---|
| 4,449,811 | 5/1984 | Betron et al. | 271/251 X |
| 5,129,641 | 7/1992 | Long | 198/460.1 X |
| 5,186,336 | 2/1993 | Pippin et al. | 209/900 X |
| 5,207,331 | 5/1993 | Teegarden et al. | 209/583 X |
| 5,238,120 | 8/1993 | Ballestrazzi et al. | 209/583 X |

FOREIGN PATENT DOCUMENTS

| | | | |
|---|---|---|---|
| 215469 | 3/1987 | European Pat. Off. | 209/900 |
| 3604806 | 8/1987 | Germany | 209/539 |

*Primary Examiner*—Tuan Nguyen
*Attorney, Agent, or Firm*—Needle & Rosenberg, P.C.

[57] ABSTRACT

An optical recording and sorting apparatus and method by which documents are stripped from the other documents in a stack and aligned, the data from each document is recorded, and then the documents are segregated into categories based on the data recorded. An apparatus for sequentially registering the documents is used that both separates the documents at desired distance from each other and aligns the documents on a desired movement path.

42 Claims, 6 Drawing Sheets

OPTICAL SORTER, TRACKER AND READER

BACKGROUND OF THE INVENTION

1. Field of the Invention

This invention relates to an apparatus and method for optically recording selected data from a plurality of documents and sorting the documents into desired categories based on the data processed. Furthermore, the present invention may store and process the recorded data. The present invention also relates to separating and sequentially aligning the documents to be recorded.

2. Background Art

Corporations and governments continuously receive documents that must be sorted into groups. Examples of the documents that are sorted and processed include checks, vouchers, coupons, food stamps, and the like. Once these documents are sorted, they are then processed. Alternatively, the documents can be sorted and processed at the same time. Either way, it is a labor-intensive and expensive process.

Accordingly, organizations pay an enormous amount of money each year for their employees to perform these tasks. Many times, the documents cannot be both sorted and effectively reviewed for tampering or fraud because of the large volume of documents involved. This inability to sort, process, and audit documents properly is especially true today given the downsizing of governments and corporations and the resulting decrease in manpower.

To attempt to address these problems, machines that read magnetic code have been used. An example of a magnetic code is that on the bottom of a check or back of a credit card. However, it is impracticable and expensive to use a magnetic code for each document that a government or corporation uses. Magnetic readers are also limited in that they are restricted to read only information that is in the proper magnetic form. Thus, this type of machine or process cannot identify whether the document has been fraudulently used. Nor can magnetic reads discern information that has been inserted onto the face of the document. For example, the use of a magnetic code reader could not indicate the payable amount of a check, in contrast to an optical reader. Another limitation is that only a size of documents can be processed at one time. Documents of other sizes or with the magnetic code at a different location cannot be processed concurrently, and therefore will either stop the processing run or never be read. Furthermore, this type of system cannot function properly if the document being processed is damaged, tattered, or torn.

Another example of the prior art addressing this problem is the use of machines that read bar codes. Again, this solution has many weaknesses. It would be expensive for an organization to use a bar code on each document that requires sorting. Another limitation of this type of system is that the bar code is worn or damaged, it is difficult, if not impossible, to be read by the system. There is also a problem because a bar code reader cannot detect fraud. And, as with magnetic readers, a bar code system cannot read information manually added to or altered on the documents.

Therefore, a need exists in the art to provide a system that can both process and sort documents at a very rapid rate. This system should be able to preform this function without the extensive use of labor that exists in the current systems.

SUMMARY OF THE INVENTION

The above disadvantages of the prior art are overcome by the present invention which provides an apparatus and method for optically sorting a plurality of documents.

The present invention comprises (1) a frame; (2) a means on the frame for feeding the documents from a first position to a second position having an entrance portion and an exit portion, wherein each document is separated from other documents such that a single document at a time passes through the exit portion of the feeding means to the second position; (3) a means for registering each document, located at the second position and having a front portion adjacent the exit portion of the feeding means and an opposite end portion, wherein the registering means aligns the documents to be sorted and creates a desired spacing between each document; and (4) a means, downstream from and adjacent to the end portion of the registration means, for recording selected data from each document.

The present invention can also encompass a means, after the data recording means, for sorting the documents into a desired organization based upon the data processed on each of the documents by the data recording means. There is also provided a means for transferring data from the recording means to the sorting means.

In addition, the present invention can further comprise a means, adjacent the entrance portion of the feeding means, for loading the documents to be supplied to the feeding means.

As an overview, a simplified view of the present invention is shown in FIG. 1. The loading means can comprise a document tray 60 disposed above a load belt 69.

The documents on the loading means can then be transferred to the feeding means. The feeding means comprises a feed belt 20, a feed wheel 30, and a retarding wheel 34. The lowermost document in the stack of documents is stripped from the stack and directed towards the registration means.

The registration means comprises a registration belt 40 and an overhead ball rack 50. The registration means aligns the documents before they reach the data recording means which can comprises at least one optical reading device 70 and a data processor 76. Here, data is recorded and processed from each document. This processed data can be sent, via the data transferring means, to the sorting means.

At the sorting means, documents can be collated into different hoppers 90 based on the recorded data. The sorting means can comprise a plurality of advancing means 80 in an end-to-end alignment, a hopper 90 for each advancing means 80, and one finger 85 for each hopper 90 that is responsive to the data recording means, wherein the finger 85 can direct the appropriate document into the appropriate hopper 90. An upper conveyor 81 can also be used.

It is an object of this invention to optically assimilate data from documents for further processing. The data can be used to sort the documents into desired categories.

It is also an objective of this invention to store the data optically read from the documents. This data may be collated, as desired. Collation can be directed by a software program.

Another objective of the present invention is to sort the documents at a very high speed. A prototype of the present invention can process up to 30,000 vouchers per hour.

Still another objective of the present invention is to optically process information that is indiscernible to prior art machines, such as water marks, or even invisible to the human eye, such as ultraviolet ink.

It is likewise an objective of the present invention to process information that is set forth on a document in a conventional manner, as with bar codes.

Another object of the invention is to sort information collected electronically instead of mechanically. To this end, the present invention can process all the information electronically without the need to sort the documents physically. The present invention can also encompass a microfiche system in which the documents do not need to be sorted mechanically. It would be preferable to perform some sorting, however, to segregate those documents that are not readable from other documents.

It is also an object of the present invention to process documents that are not crisp and new. The present invention successfully functions if the documents being processed are worn and tattered.

It is also an object of the present invention to align properly documents in a serial manner so that they may be read by a scanner or other instrument.

Yet still another object of the present invention is to process documents of different sizes. This processing may include sorting the documents of different sizes without optically reading all of them or reading all of the documents with the same or different optical device.

DETAILED DESCRIPTION OF THE INVENTION

The present invention may be understood more readily by reference to the following detailed description of specific embodiments and the Figures included therein.

OVERVIEW

Figure 1:
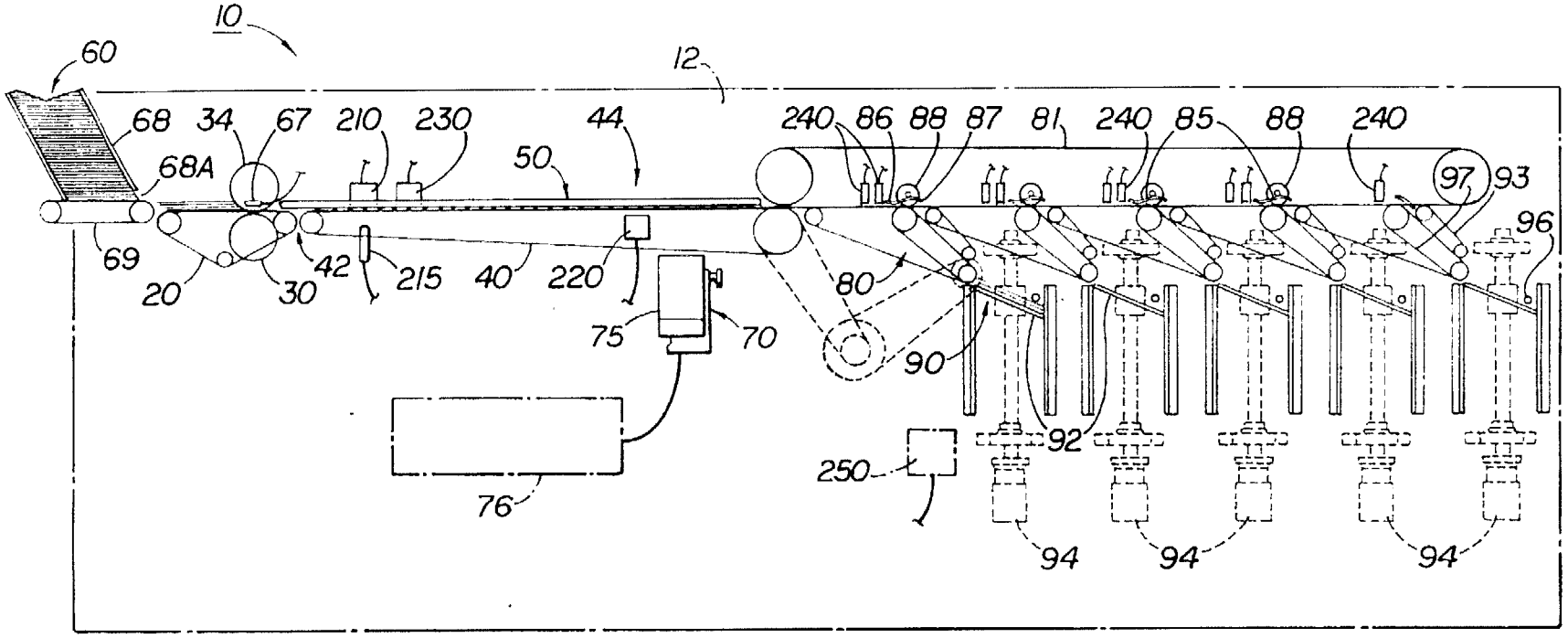
FIG. 1 is a simplified side elevational view of the present invention partially in schematic form.
Figure 4A:
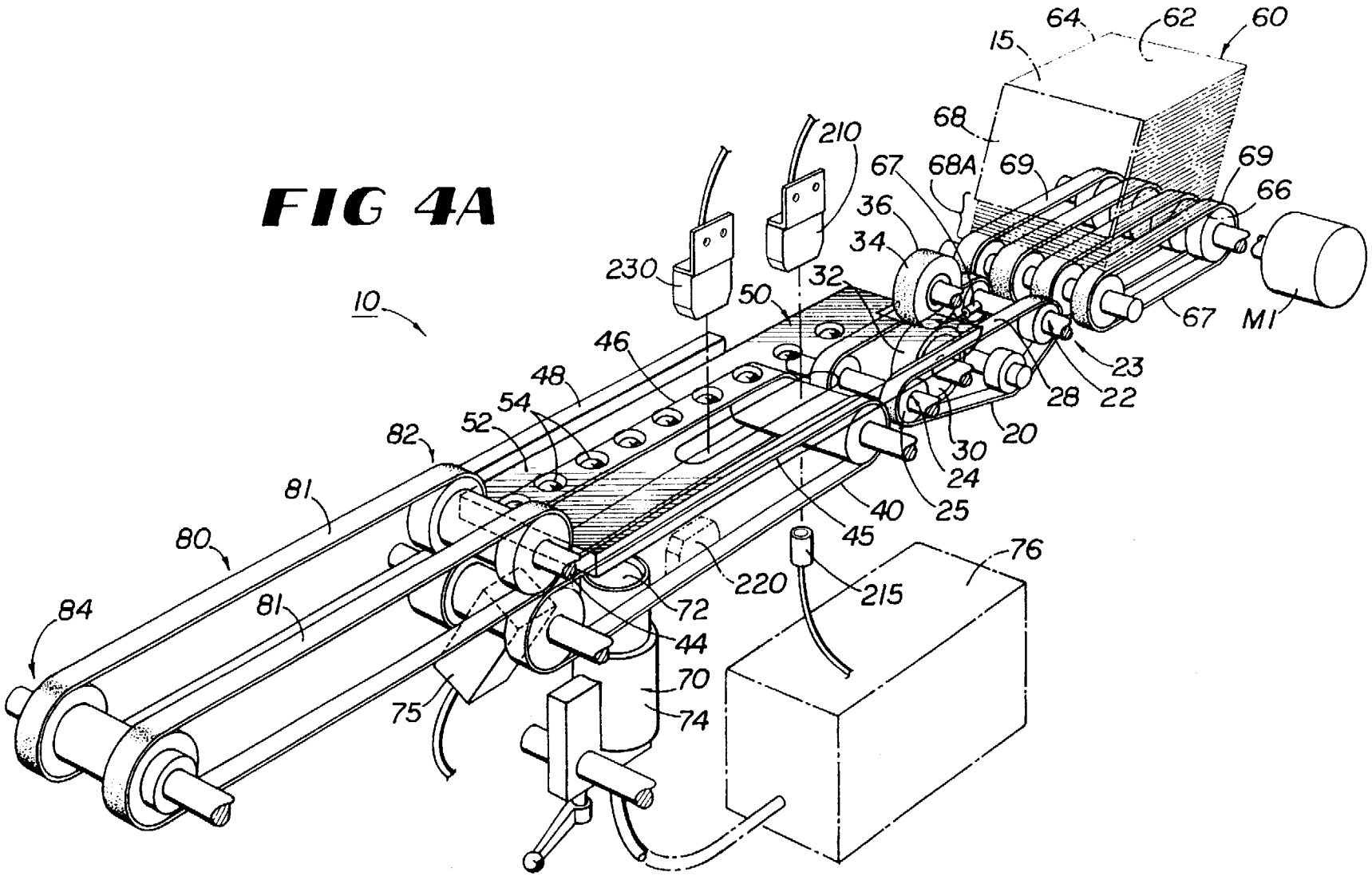
FIG. 4A is a partial perspective view of the document handling side of the present invention.
Figure 4B:
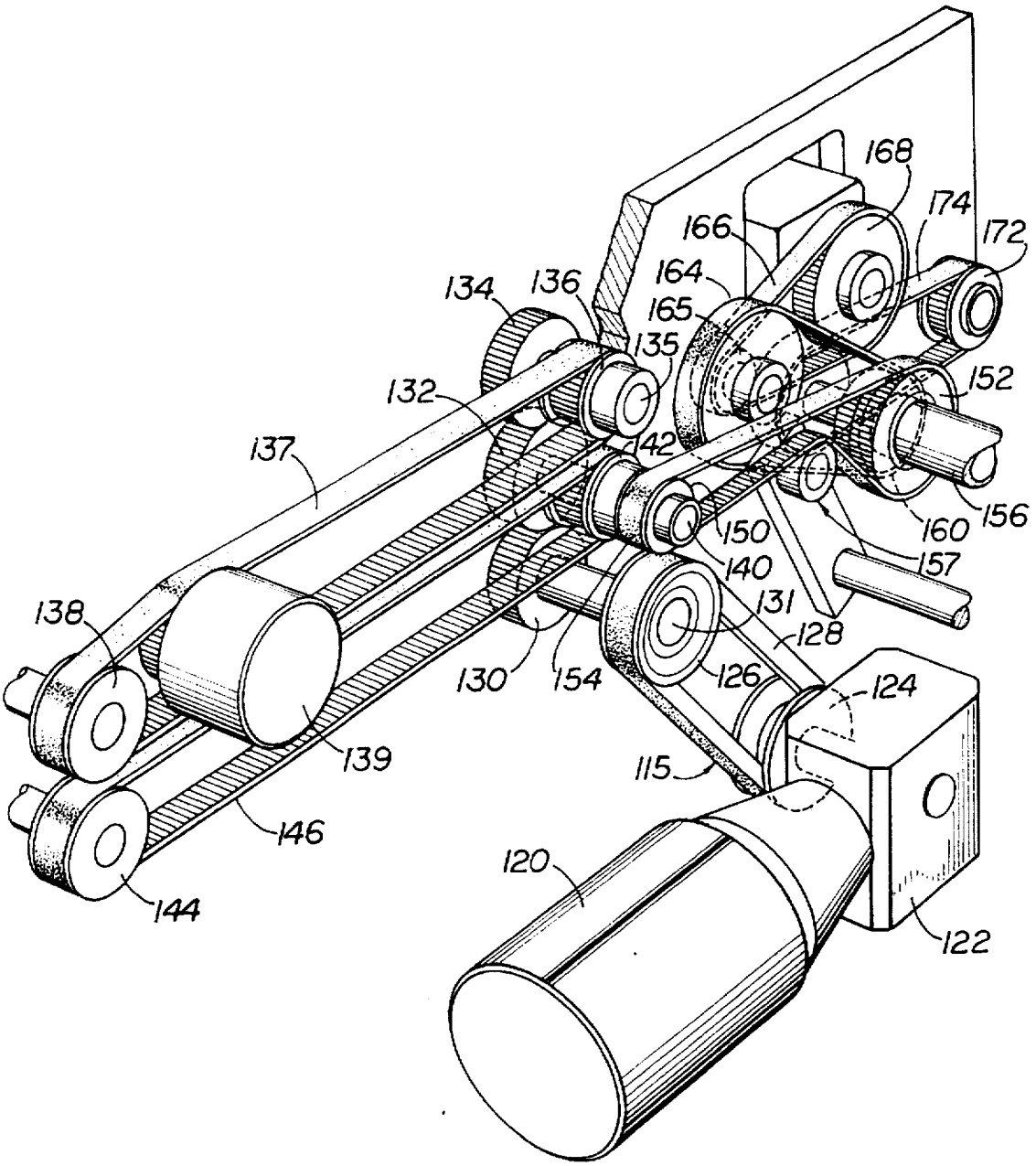
FIG. 4B is a perspective view of the drive train side of the present invention.
Figure 5:
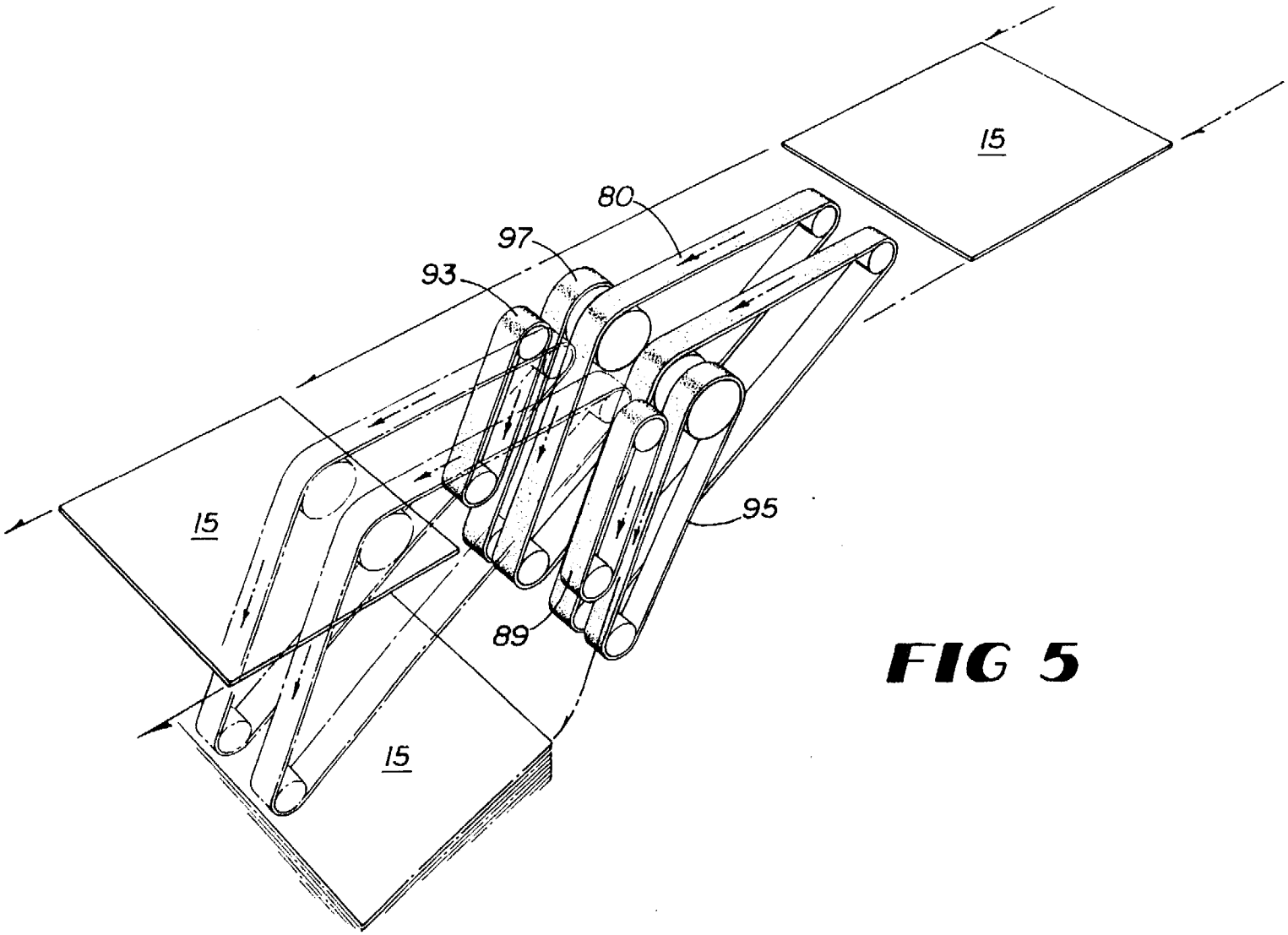
FIG. 5 is a perspective view of the sorting means of the present invention.
Figure 6:
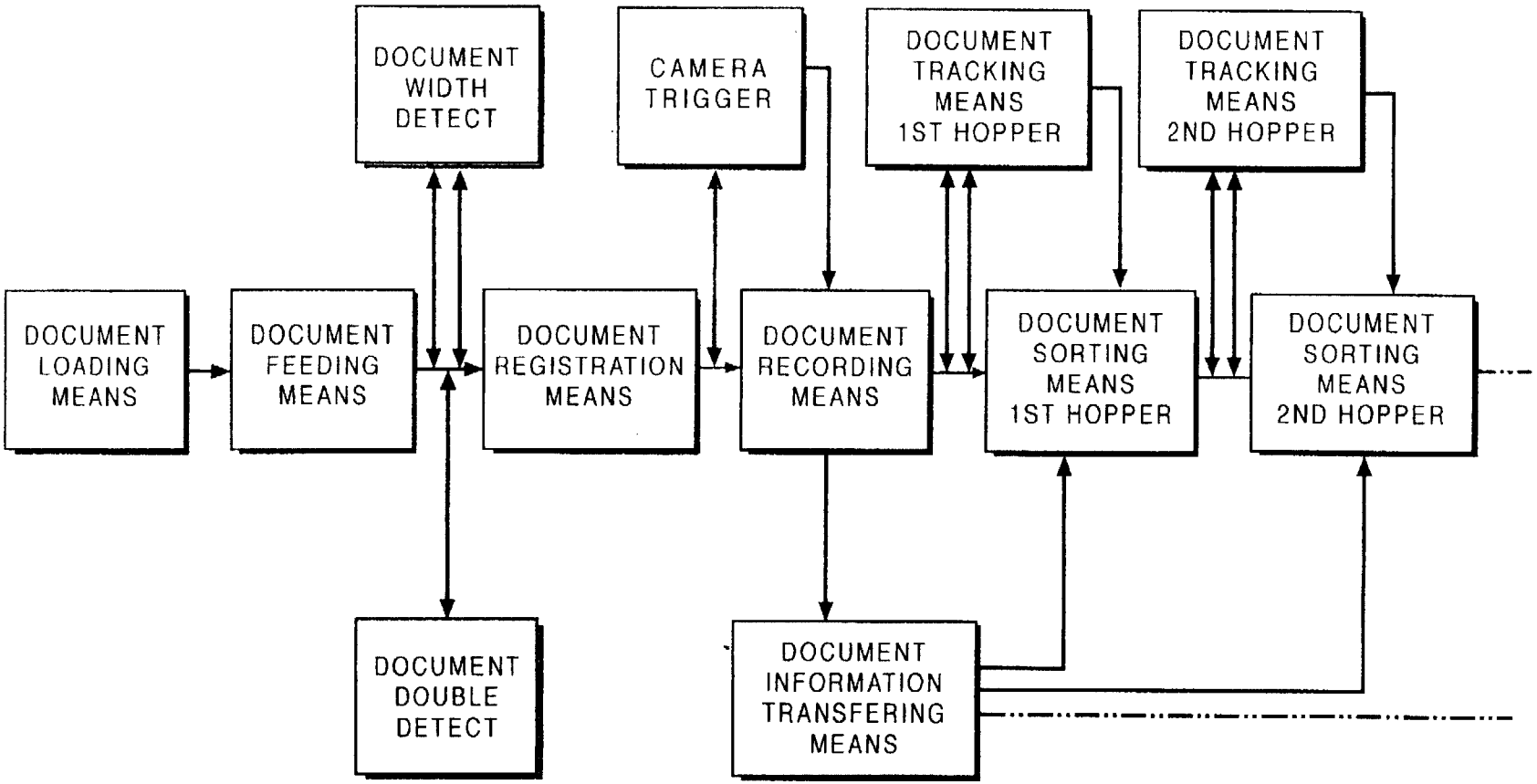
FIG. 6 is a block-diagram of the present invention.

Referring now generally to FIGS. 1–6, one embodiment of the present invention, apparatus 10 for optically sorting a plurality of documents, is shown. As shown in FIGS. 1 and 4A, the apparatus 10 comprises: a frame 12; a means on the frame 12 for feeding the documents 15 from a first position 22 to a second position 24 having an entrance portion 23 and an exit portion 25, wherein each document 15 is separated from other documents 15 such that a single document 15 passes at a time through the exit portion 25 of the feeding means to the second position 24; a means for registering each document 15, located at the second position 24 and having a front portion 42 adjacent the exit portion 25 of the feeding means and an opposite end portion 44, wherein the registration means aligns the documents 15 to be sorted and creates a desired spacing between each document 15; and a means, downstream from and adjacent to the end portion 44 of the registration means, for recording selected data from each document 15. FIG. 6 illustrates the interrelationship of these components in the form of a block flow-diagram.

The apparatus 10 can also comprise a means, adjacent the data recording means, for sorting the documents 15 into a desired organization based upon the data processed on each of the documents 15 by the data recording means. Associated with the sorting means is a means for transferring data from the recording means to the sorting means. Additionally, the present invention can comprise a means for loading documents 15 to be supplied to the feeding means.

The apparatus 10 is operated by a power means which is discussed below.

THE LOADING MEANS

In the preferred embodiment, the loading means is adjacent the entrance portion 23 of the feeding means. The loading means can comprise a document tray 60 having a document receiving hopper 62 with a top end 64 and a lower end 66, a gate means 68 disposed intermediate the loading means and the feeding means for selectively limiting the flow of documents from the loading means to the feeding means through opening 68A, and a load belt 69. The load belt 69 is disposed adjacent the lower end 66 of the document receiving surface 62. The load belt 69 can move a plurality of documents 15 onto the entrance portion 23 of the feeding means, wherein the gate means 68 allows the documents 15 to move onto the feeding means only one at a time.

The gate means 68 is disposed across a portion of the document tray 60 transverse to the path of travel of the documents 15 and adjacent the lower end 66 of the document tray 60. Thus, only a selected quantity of documents 15 can pass beneath the lower end 68A of the gate means 68 to be moved onto the entrance portion 23 of the feeding means at any time.

It is also preferable to include a means for controlling the movement of the load belt 69 and means, connected to the controlling means, for detecting the quantity of documents 15 on the entrance portion 23 of the feeding means. The controlling means can start the movement of the load belt 69 which moves documents 15 onto the feed means when the quantity of documents 15 on the entrance portion 23 of the feeding means reaches a first selected level, as detected by the detecting means. The controlling means can stop the movement of the load belt 69 when the quantity of documents on the entrance portion 23 of the feeding means reaches a second selected level, as detected by the detecting means. The detecting means preferably is a fiber optic sensor 67, electronic eye, photoelectric cell, or the like. In the preferred embodiment, the fiber optic sensor 67 is Microswitch MPF6 model number 800-271.1.

In the preferred embodiment, a small motor M1 operates the load belt 69. This small motor, operated by the controlling means, is independent of the powering means and associated gear system discussed below. However, the prime mover for the load belt 69 could alternatively be the powering means. However, it would be more desirable to have the movement of the load belt 69 controlled by the controlling means.

THE FEEDING MEANS

The feeding means can comprise a feed belt 20 having a top surface 28 upon which a stack documents 15 is disposed, a feed wheel 30 located downstream from the stack of documents 15, and a retarding wheel 34. There is also a power means for rotating the feed belt 20, the feed wheel 30, and the retarding wheel 34, the preferred embodiment of which is discussed below.

The feed belt 20 can be a single wide belt or, more preferably, a plurality of spaced apart narrower belts which have top surfaces 28 that are in the same place. The feed belt 20 is movable at a first selected speed. Operation of the feed belt 20 causes the lowermost document within the stack of documents 15 to be moved toward the registration means. As the lowermost document advances, it comes into contact with the feed wheel 30.

The feed wheel 30 has an outer circumference 32 which contacts the bottom surface of the lowermost document. A portion of the outer circumference 32 preferably is adjacent the top surface 28 of the feed belt 20. It is also preferred to dispose the feed wheel 30 intermediate two narrower feed belts 20. The outer circumference 32 of the feed wheel 30 can sequentially the lowermost document from the stack and move it toward the registration means.

The rotatable retarding wheel 34 has an outer periphery 36 which is disposed above and in registry with the outer circumference 32 of the feed wheel 30. The outer periphery 36 can rotate to move the documents above the lowermost document 15 in the stack in a direction opposite the registration means. The concurrent, opposing motion of the retarding wheel 34 in conjunction with the movement of the feed wheel 30 enables only one document 15 to be sequentially advanced toward the registration means at a time. The retarding wheel 34, in other words, opposes downstream movement of any document in the stack, other than the lowermost document.

It is preferred that the outer circumference 32 of the feed wheel 30 has a first coefficient of friction and the outer periphery 36 of the retarding wheel 34 has a second coefficient of friction, wherein the second coefficient of friction is less than the first coefficient of friction of the feed wheel 30. This facilitates the stripping of the lowermost document and separating the stripped document 15 from the other documents 15 in the stack. The stripping is also aided by a speed differential that can exist between the feed wheel 30 and the retarding wheel 34, wherein the feed wheel 30 rotates at a greater angular velocity than the retarding wheel 34.

THE REGISTRATION MEANS

Figure 2:
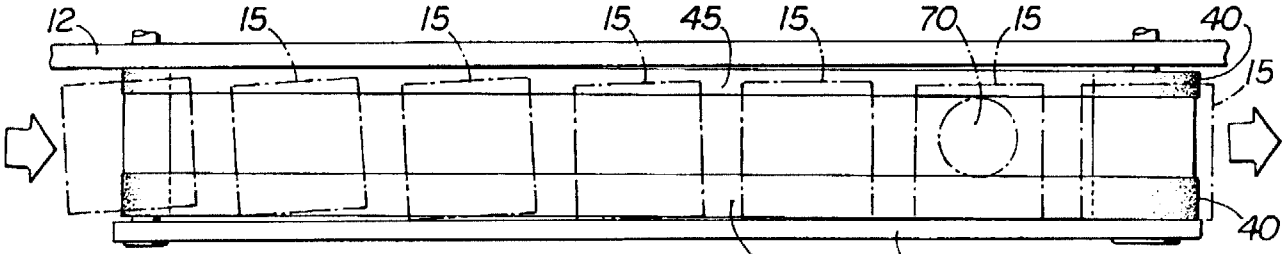
FIG. 2 is a schematicized plan view of the registration section showing a document being aligned.
Figure 3:
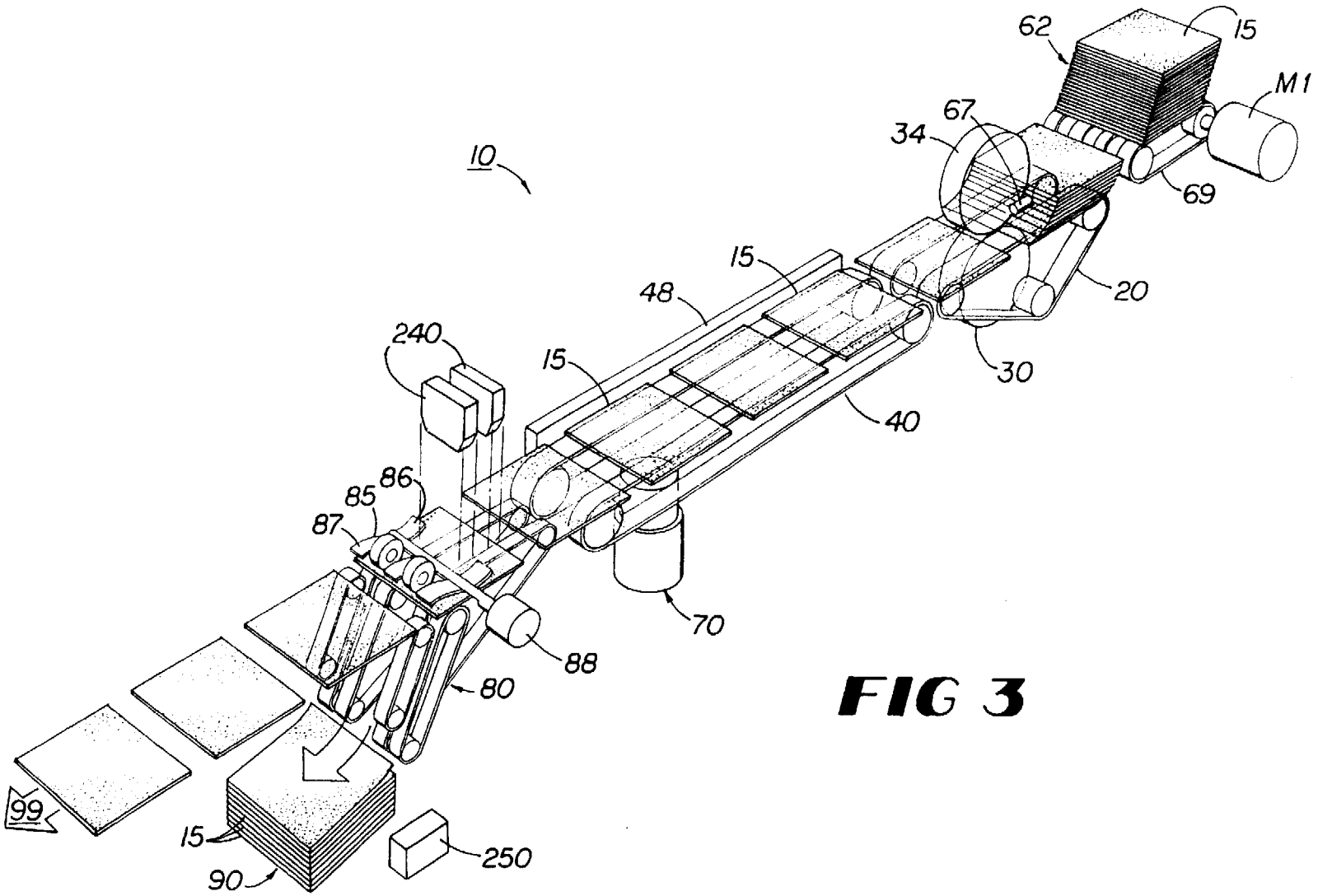
FIG. 3 is a perspective view of the present invention showing the documents being processed.

The registration means can comprise a registration belt 40 rotating at a second selected speed for moving each stripped document 15 toward the data recording means. As with the feed belt 20, it is preferable to have a plurality of narrower belts instead of one wider registration belt 40. As shown in FIGS. 2, 3 and 4A, the registration belt has two parallel flights 45, 46. The registration belt 40 preferably is disposed at an angle relative to the longitudinal axis of the frame 12. In the preferred embodiment, the registration belts 45, 46 are angled at one degree relative to an edge 48. The registration belts 45, 46 are farther from the edge plate 48 adjacent the front portion of the registration section and converge closer to the edge plate 48 downstream. That is, edge plate 48 forms an alignment fence extending adjacent the registration belt 46. Thus, the stripped document 15 moving toward the data recording means moves laterally toward the edge plate 48 as it continually advances longitudinally toward the data recording means on the registration belt 40. One side of the document 15 eventually slidably abuts the edge plate 48, prior to reaching the data recording means, as it advances on the registration belt 40. This alignment design functions even if the document 15 is tattered or damaged. These documents are generally stacked in a substantially correct orientation with printed information face down. However, in order for the information to be accurately captured by the optical recorder, they must be aligned and separated in a single file for presentation to the camera. FIG. 2 illustrates the path of one such document 15 as it moves through the registration section. The document 15, as shown, can enter at a skewed angle, and as it progresses through the registration section, the convergent belts 45, 46 (oriented at one degree with respect to the edge plate 48) urge a side edge of the document into contact with the edge plate 48. As the document 15 contacts the edge plate 48, it is urged into alignment with the edge plate 48 and placed in proper registration for the data recording means. In this instance, the trailing edge of the document 15 contacts the edge plate 48 first and the leading edge is gently brought into contact with the edge plate 48 via the path of the registration belts 45, 46. The result is to sandwich the document 15 between the registration belts 45, 46, the edge plate 48, and the almost frictionless light pressure of the ball rack 50 above the document 15.

Alternatively, the registration belt 40 can be disposed at an angle relative to the horizontal plane, whereby one edge of the belt is elevationally lower than the other edge. The edge plate 48 extends longitudinally adjacent the elevationally lower edge of the registration belt 40. Thus, the stripped document 15 slides laterally downwardly toward the edge plate 48 as it moves toward the data recording means or the registration belt 40. The document, thus, eventually slidably abuts the edge plate 48 prior to reaching the data recording means.

It is preferred that the registration belt 40 rotates at a second selected speed, which is faster than the first selected speed of the feed belt 20. This differential in the speeds causes the documents exiting the feeding means and entering the registration means to be separated from each other at a distance proportional to the speed differential. That is, the faster the second selected speed is relative to the first selected speed, the larger the separation between documents 15. In the preferred embodiment, the second selected speed is between 180 and 200 feet per minute.

It is also preferable that the registration means further comprises a ball rack 50 disposed elevationally above and parallel to the registration belt 40. The ball rack can have a frame 52 and a plurality of balls 54 therein. The balls 54 are all disposed in the same plane and are freely rotatable within the frame 52 through individual openings therein such that a portion of the balls 54 extends below the frame 52 and contacts the upper surface of each document 15 moving on the registration belt 40. The ball rack 50 thus ensures that the bottom of the documents 15 remains on the registration belt 40. The ball rack 50 helps to minimize external interference with the movement and alignment of documents 15, such as air currents or gusts. The ball rack 50 is particularly important with the preferred embodiment because the system operates at extremely high speeds which could otherwise cause the documents to lift off the registration belt 40.

THE DATA RECORDING MEANS

The data recording means can comprise at least one optical reading device 70 and a data processor 76 responsive to the optical reading device 70. There can be more than one optical reading 70 device used with one or more corresponding data processors 76. It has been found advantageous to use slave data processors 76 for each optical reading device to accommodate the high speeds of the preferred embodiment. For two or more optical reading devices 70, it is preferable to align the devices 70 in series and have each optical reading device 70 record specific data from the documents 15.

The optical reading device 70 can comprise a lens 72 for focusing on the face of the document 15 aligned therewith. The lens 72 creates a light signal from the document so that the optical processor 74 can convert the light signal into digital signal to be imputed into the data processor 76. The lens 72 can be a television camera-type lens, such as a Fugi model CF 12.5A. Other lenses are also acceptable. It is also preferable to have two halogen lights 75 positioned on either side of the lens 72 to illuminate the document 15 to be recorded. The lights 75 allow the lens 72 to operate at its highest efficiency.

The types of optical reading devices 70 that can be used are numerous. For example, the present invention can include an optical reading device 70 that checks for specific watermarks on the documents 15, specific ink types, and other characteristics in addition to conventional lenses for recording data. This is one way the present invention can segregate documents that are forgeries, counterfeit, or fraudulently altered.

The data processor 76 can further comprise a means for comparing the signal from the optical processor 74 for each document 15 to preselected categories programmed in the data processor 76 and a means for sending an output signal from the data transferring means. The output signal is preferably based on the category which the data processor 76 determined that the document 15 belongs. This output signal can be directed to the sorting means, whereby the sorting means collates the documents 15 into the appropriate category.

The data processor 76 in the preferred embodiment uses hardware that is hardwired together. A processor in the form of a computer chip, such as the PENTIUM™, can be used. However, in the preferred embodiment that process 30,000 documents per hour, this alternative arrangement is not fast enough to support this high processing rate.

It is also preferable that the data processor 76 stores data conveyed from the optical reading device 72. This data can then be electronically sorted, alleviating the need to physically sort the documents 15.

It is also contemplated that software can be programmed to specify the data to be obtained from the documents 15 and the categories into which to sort the documents 15. Each set of documents 15 processed, therefore, can be sorted based on completely varying criteria. For example, the documents could be categorized before reaching the data recording means (e.g., the width of the document indicating its category) and at the data recording means, data could be recorded based on the category of the document. Thus, more than one type of document could be processed and sorted in a single run. There can also be a comparison of two or more different codes on a document to determine whether the document has been altered. And, since the comparing can be done digitally, it may be performed at an extremely high speed.

The present invention can also process different forms of data from documents, including bar codes and visual indications of magnetic codes. The present invention, thus, can more advantageously perform the function of the prior art systems, and additionally have the benefit of recording more data at a faster rate.

THE SORTING MEANS

The sorting means can comprise at least one advancing means 80 having an entrance end 82 adjacent the data recording means and an exit end 84 such that the exit end 84 of one advancing means 80 is adjacent and longitudinally aligned with the entrance end 82 of the next sequential advancing means 80, a power means to move the advancing means 80, at least one segregating means, and at least one hopper 90. The power means is discussed below.

Each hopper 90 can be disposed adjacent each segregating means so that each segregating means directs documents 15 of a preselected category into the adjacent hopper 90 that is designated for that category of document 15. This enables the documents 15 to be sorted.

It is preferable that one segregating means be disposed adjacent the exit end 84 of each advancing means 80. In the preferred embodiment, each segregating means can comprise a finger 85 having a distal end 86 and a proximal end 87 which rotates about a horizontal axis and a rotary solenoid 88 mechanically coupled to the distal end 86 of the finger 85. The rotary solenoid 88 in the preferred embodiment is responsive to the data recording means. The rotary solenoid 88, when energized, directs the proximal end 87 of the finger, which is positioned above the path of travel of the document 15, to rotate downwardly so that the distal end 86 of the finger 85 engages the upper surface of the document 15. This pushes the document downwardly off of the exit end 84 and directs the document into the corresponding hopper 90. After the document 15 is directed into the hopper 90, the rotary solenoid 88 is deenergized which causes the distal end 86 of the finger 88 to return to its normal position by moving upwardly. When the rotary solenoid 88 is in the deenergized position, the finger 85 will not contact the document 15 and the document 15 will continue its movement on to the next advancing means 80. It is also contemplated that segregating means can encompass other types of systems such as one in which the separation occurs in the horizonal plane, e.g., similar to directing trains to different tracks.

In the preferred embodiment, the rotary solenoid 88 is a 12 volt solenoid in series with a capacitor. A 24 volt signal is used to energize the rotary solenoid 88. This voltage provides a large initial current to cause the distal end 86 of the finger 85 to move rapidly downward. This rapid movement is necessary in the preferred embodiment wherein approximately 30,000 documents per hour are processed. The current through the rotary solenoid 88 then drops as the voltage of the capacitor increases, and the potential across the rotary solenoid 88 decreases. Thus, the rotary solenoid 88 is not damaged because of a high current for an extended duration. Enough voltage differential is maintained to maintain the distal end 86 of the finger 85 in the downward position until the document 15 is directed into the hopper 90. Then the rotary solenoid 88 is deenergized and the capacitor discharges, rapidly allowing the finger 85 to rotate upwardly about the proximal end 87 so that the distal end 86 is out of the path of travel of the advancing means 80.

As an example of the high speeds required, there is only a 14 millisecond time period between the document exiting the data recording means and the first finger 85 being required to direct the document into the first hopper 90, if appropriate.

It is preferred that each advancing means 80 is an endless belt. Other variations are possible, however, such as a plurality of rotating rollers and the like. There can also be an upper conveyor 81 disposed above the advancing means 80. The upper conveyor 81 can operate by the power means discussed below. The upper conveyor 81 can be one endless belt, but more preferably a plurality of spaced-apart belts. This upper conveyor 81 can serve the same purpose as the ball rack 50 in that it keeps the documents 15 from being affected by external forces, such as air currents.

In a preferred embodiment, as shown in FIG. 5, other belts in addition to the advancing means 80 can be used to direct the documents 15 into each hopper 90. The additional belts can include four sorter belts: an inboard upper sorter belt 89, an outboard upper sorter belt 93, an inboard lower sorter belt 95, and an outboard lower sorter belt 97. These four belts, in addition to each advancing means 80, affirmatively direct each document into each hopper 90. These four belts can also be driven by the power means.

There can be one advancing means, as shown in FIG. 1, wherein the rotary solenoid 88 is energized if the document 15 is to be directed to the one hopper 90 and not energized if the document 15 is to go to a second location 99. In another embodiment, there can be at least two advancing means 80. The set of advancing means 80, hoppers 90, and segregating means can be installed as modular units. In the preferred embodiment, there are five such sets which allow the documents to be sorted into five different categories. Also in the preferred embodiment, the last finger 85 is always in the downward, or energized, position so that the distal end 86 thereof contacts any document reaching that location to direct the document into the last hopper 90.

Each hopper 90 can further comprise a document receiving plate 92 and a means for vertically adjusting the level of the plate 92 within the hopper, depending upon the quantity of documents on the plate 92. The vertical adjusting means can be an elevator 94. The vertical adjusting means can further comprise a level detection means for determining the quantity of documents on the plate 92. The level detecting means can have an output that controls the vertical adjusting means so that the level detection means moves the plate 92 downwardly when the quantity of documents 15 reaches a first selected level as detected by the level detection means, stops the downward movement of the plate 92 when the quantity of documents 15 reaches a second selected level as detected by the level detection means, and moves the plate 92 upwardly when documents 15 are removed from the plate 15 until the quantity of documents 15 is at a third selected level as detected by the level detection means. The level detection means can be an electronic eye 96, a photo electric cell, a weight detector, and the like. In the preferred embodiment, the level detection means is a Microswitch fiber optic sensor, model number 800-271.1.

ADDITIONAL SENSORS

The present invention can also comprise a means, intermediate the feeding means and the registration means, for detecting overlapping documents. The overlapping detection means can be a light source 215 and a corresponding electric eye 210 disposed in registry above and below the document 15 respectively. These two components 210, 215 measure the density of the document by detecting a decrease in transmittance of light therebetween. Thus, if two documents overlap each other, the light transmittance detected by the opposing electronic eye 210 falls below a preselected level which indicates that two or more documents 15 are overlapping. The overlapping detection means can have an output that triggers an interlock which stops operation of the apparatus 10. This way, there is no chance that all of the desired data from a document 15, which may be obscured by an overlapping document 15, will not be recorded. In the preferred embodiment, the detectors are an Omron E3X-F21 with an E32-TC200 fiber.

The apparatus 10 can further comprise a means, intermediate the registration means and the data recording means, for triggering the data recording means to optically view each document. The triggering means can be an electronic eye 220 electrically coupled to the data recording means. In an alternative embodiment, the triggering means could be absent so that the recording means would operate at a predetermined time sequence which corresponds to the approach of each document 15.

The apparatus can likewise further comprise a means, intermediate the feed means and the data recording means, for determining the width of the documents 15. The width determinating means can be an electronic eye 230 electrically coupled to the data recording means. The width determinating means thus allows the apparatus 10 to process different types of documents. For example, if the width of the document is a first selected size, then the data from it would be recorded by a first optical reading device 70. If the document 15 is of a second selected size, then the data from it would be recorded by a second optical reading device 70 or the document 15 could be sorted without any data from it being recorded.

The apparatus 10 can also further comprise a means, adjacent each hopper 90, for sensing the approaching documents 15. The approaching document sensing means can be a pair of electronic eyes 240 electronically coupled to the data collection means. This approaching document sensing means can have an output connected to the data processor 76 to track the documents 15. The data processor 76 can then track the documents 15 to energize the appropriate rotary solenoid 88 to move the associated finger 85 downward to direct the document 15 into a pre-selected hopper 90.

The apparatus can further comprise a counting apparatus 250 disposed in each hopper 90, wherein the counting device 250 indicates the number of documents 15 that have entered that hopper 90. The output of the counting apparatus 250 can be compared to the data processor 76 to ensure that no errors occurred during the sorting operation.

THE POWER MEANS

As shown in FIG. 4B, the preferred embodiment of the power means comprises a gearing drive system 110. It will be appreciated that a prime mover can operate the gearing drive system 110 at a single speed and the individual speed of all the moving belts and wheels discussed above can be set by using different gear ratios.

The prime mover can be a gear head motor 120, which, preferably, is approximately one-half horsepower. The motor can be directly connected to a gear transfer box 122 that translates the energy of the motor 120 to rotational energy to drive a pulley system 115. The gear transfer box 122 and the associated gear system 110 allows both the motor 120 and the pulley system 115 to operate at the respective most efficient speeds.

The output of the gear transfer box 122 can be directly coupled to a first drive pulley 124 which can be mechanically linked to a second drive pulley 126. The linkage between these two drive pulleys 124, 126 can be a pulley belt 128.

The second drive pulley 126 is mechanically coupled to a spur gear 130 via a transfer shaft 132. The spur gear 130 is the source of rotational energy to drive the rest of the gearing system 110. The spur gear 130 mates with the registration spur gear 132 which, in turn, engages with a sorter spur gear 134. Thus, the spur gear 130 drives the registration spur gear 132 which drives the sorter spur gear 134.

The sorter spur gear 134 is a sorter drive shaft 135 fixedly attached to its center. On the opposing side of the sorter drive shaft 135 is a first sorter belt drive gear 136 so that the first sorter belt drive gear 136 and the sorter spur gear 134 form a compound gear. Rotatably affixed to the first sorter belt drive gear 136 is a sorter timing belt 137 which interconnects a second sorter belt drive gear 138. The second sorter belt drive gear 138 is the prime mover for the upper conveyor 81 and can also drive the advancing means 80. It is also preferred to install an encoder 139 having an output connected to the data processor 76 to indicate the speed of the belts and gears.

Likewise, the registration spur gear 132 has a feed power transfer shaft 140 fixedly attached to its center. A first registration belt drive gear 142 is also fixedly attached to the feed power transfer shaft. Rotatably affixed to the first registration belt drive gear 142 is a registration timing belt 146 which is interconnected to a second registration belt drive gear 144. The second registration belt drive gear 144 is thus the prime mover for the registration belt 40 and can also drive the advancing means 80.

In addition, a first feed power drive gear 150 is fixedly attached to the feed power transfer shaft 140. Rotatably affixed to the feed power drive gear 150 is a feed power transfer belt 154 which is interconnected to a feed wheel drive gear 152. Preferably, a spring loaded tensioner 157 is intermediate the first feed power drive gear 150 and the feed wheel drive gear 152 to keep the feed power transfer belt 154 taut.

The feed wheel drive gear 152, which is driven by the feed power transfer belt 154, has a feed wheel shaft 156 going through the center of feed wheel drive gear 152. The feed wheel shaft 156 has two other gears mounted thereon: a first step-down gear 160 and a first feed belt drive gear 170.

The first step-down gear 160 is connected to a second step-down gear 162 by a first step-down timing belt 164. The second step-down gear 162 is fixedly attached to a third step-down gear 165, wherein the second step-down gear 162 and the third step-down gear 165 have a common center mounted on a common shaft. The third step-down gear 165 is rotatably adjoined with a second step-down timing belt 166. The second speed step down timing belt 166 is interconnected to a retarding wheel gear 168. This arrangement of step-down gears and timing belts allows the retarding wheel 34 to rotate more slowly than the feed wheel 30. The angular speed of the retarding wheel 34 and the feed wheel 30 are proportional to the pitch circle diameters of the step-down gears.

The first feed belt drive gear 170 is also fixedly attached to the feed wheel shaft 156. The first feed belt drive gear 170 is rotatably coupled to a second feed belt drive gear 172 via a feed belt timing belt 174. The second feed belt drive gear 172 is mechanically coupled to the feed belt 20 to act as its prime mover. The size of the gears preferably are chosen so that the feed belt 20 moves at a first selected speed which is slower than the registration belt 40. As discussed above, this allows the advantageous separation of documents prior to reaching the data recording means.

METHOD OF THE PRESENT INVENTION

The present invention also comprises a method for optical sorting a plurality of documents. The first step is providing a stack of documents 15 to be optically sorted. The next step is stripping the lowermost document 15 from the bottom of the stack of documents 15. The method next entails maintaining a separation between each stripped document 15 and then directing the separated documents 15 to a first location. The method then includes the step of aligning the documents, prior to reaching a second location on a predetermined path. The method then has the step of recording selected data from each document 15 at the second location. The next step is then transferring the documents 15 to a selected second location. Optionally, the select location for each document can be determined based on the recorded data.

This method can further comprise the steps of either storing the data from each document, or providing a visual output of the recorded data, or both after the recording step.

The method can further comprise a photoelectric eye 220 to trigger the recording step.

Although the present invention has been described with reference to specific details of certain embodiments thereof, it is not intended that such details should be regarded as limitations upon the scope of the invention except as and to the extent that they are included in the accompanying claims.

What is claimed is:

1. An apparatus for optically sorting a plurality of documents, comprising:

(a) a frame;

(b) means on the frame for feeding the documents from a first position to a second position having an entrance portion and an exit portion, wherein each document is separated from other documents such that a single document at a time passes through the exit portion of the feeding means to the second position;

(c) means for registering each document, located at the second position and having a front portion adjacent the exit portion of the feeding means and an opposite end portion, wherein the registration means aligns the documents to be sorted and creates a desired spacing between each document;

(d) means, downstream from and adjacent to the end portion of the registration means, for recording selected data from each document;

(e) means, adjacent the data recording means, for sorting the documents into a desired organization based upon the data processed on each of the documents by the data recording means; and (f) means for transferring data from the recording means to the sorting means, wherein the feeding means comprises:

(i) a feed belt having a top surface upon which a stack of the documents is disposed, the feed belt movable at a first selected speed so that the lowermost document within the stack is moved toward the registration means;

(ii) a feed wheel located downstream from the stack of documents and having an outer circumference in contact with the bottom of the lowermost document and adjacent the top surface of the feed belt, the outer circumference rotatable to strip sequentially the lowermost document and move it toward the registration means;

(iii) a rotatable retarding wheel having an outer periphery disposed above and in registry with the outer circumference of the feed wheel, the outer periphery rotating to move the documents above the lowermost document in the stack in a direction opposite the registration means to enable only one document to be sequentially advanced toward the registration means at a time; and (iv) power means for rotating the feed belt, the feed wheel, and the retarding wheel.

2. The apparatus of claim 1, further comprising means, adjacent the entrance portion of the feeding means, for loading the documents to be supplied to the feeding means.

3. The apparatus of claim 2, wherein the loading means comprises:

(a) a document tray having a document receiving surface having a top end and a lower end;

(b) a gate means disposed intermediate the loading means and the feeding means for interrupting the flow of documents from the loading means to the feeding means; and (c) a load belt adjacent the lower end of the document receiving surface, wherein the load belt moves a plurality of documents onto the entrance portion of the feeding means, whereby the gate means allows a desired quantity of documents to move onto the feeding means.

4. The apparatus of claim 3, wherein the gate means is disposed across the document tray parallel to the documents and adjacent the lower end of the document tray.

5. The apparatus of claim 1, wherein the outer circumference of the feed wheel has a first coefficient of friction and wherein the outer periphery of the retarding wheel has a second coefficient of friction which is less than the first coefficient of friction of the feed wheel.

6. The apparatus of claim 1, wherein the registration means comprises a registration belt rotating at a second selected speed for moving each stripped document toward the data recording means, the registration belt having two opposing edges.

7. The apparatus of claim 6, wherein the registration belt is disposed at an angle relative to a horizonal plane, whereby one edge is elevationally lower than the other edge.

8. The apparatus of claim 7, further comprising an edge plate longitudinally extending adjacent the elevationally lower edge of the registration belt, wherein the stripped document slides laterally downwardly toward the edge plate as it moves toward the data recording means on the registration belt so that the document eventually abuts the edge plate prior to reaching the data recording means.

9. The apparatus of claim 7, wherein the registration means further comprises a ball rack disposed elevationally above and parallel to the registration belt, the ball rack having a frame and a plurality of balls disposed in the same plane to be freely rotatable within the frame such that a portion of the balls extends below the frame and contacts the upper surface of each document moving on the registration belt, the ball rack ensuring that the bottom of the documents remains on the registration belt.

10. The apparatus of claim 1, wherein the registration means comprises a registration belt for moving each document toward the data recording means and rotating at a second selected speed, wherein the second selected speed of the registration belt is faster than the first selected speed of the feed belt, whereby the differential in the speeds causes the documents at the registration means to be separated from each other at a distance proportional to the speed differential.

11. The apparatus of claim 1, wherein the data recording means comprises:

(a) at least one optical reading device; and (b) a data processor responsive to the optical reading device.

12. The apparatus of claim 11, wherein the optical reading device comprises:

(a) a lens for focusing on the face of the document aligned therewith and creating a light signal therefrom; and (b) an optical processor to convert the light signal from the lens into digital signal to be inputted into the data processor.

13. The apparatus of claim 12, wherein the data processor comprises means for comparing the signal from the optical processor for each document to preselected categories programmed in the data processor and means for sending along the data transferring means an output signal based on the category which the data processor determined that the document belongs to the sorting means, whereby the sorting means collates the documents into the appropriate category.

14. The apparatus of claim 11, wherein the data processor stores data conveyed from the optical reading device.

15. The apparatus of claim 1, wherein the sorting means comprises:

(a) at least one advancing means having an entrance end adjacent the data recording means and an exit end such that the exit end of one advancing means is adjacent and longitudinally aligned with the entrance end of the next sequential advancing means;

(b) power means to move the advancing means;

(c) at least one segregating means, each segregating means disposed adjacent the exit end of each advancing means; and (d) at least one hopper, each hopper disposed adjacent each segregating means, wherein each segregating means directs documents of a preselected category into the adjacent hopper that is designated for that category of document, whereby the documents are sorted.

16. The apparatus of claim 15, wherein each segregating means comprises:

(a) a finger having a distal end and a proximal end; and (b) a rotary solenoid mechanically coupled to the distal end of the finger, whereby the rotary solenoid when energized directs the proximal end of the finger downwardly such that the proximal end of the finger engages the upper surface of the document which directs the document into the corresponding hopper and then the rotary solenoid is deenergized.

17. The apparatus of claim 16, wherein the rotary solenoid is responsive to the data recording means.

18. The apparatus of claim 16, wherein each advancing means is an endless belt.

19. The apparatus of claim 18, wherein there is one advancing means, wherein the rotary solenoid is energized if the document is to be directed to the hopper and not energized if the document is to go to a second location.

20. The apparatus of claim 18, wherein there are at least two advancing means.

21. The apparatus of claim 15, wherein the hoppers further comprise a document receiving plate and means for vertically adjusting the level of the plate within the hopper, depending upon the quantity of documents on the plate.

22. The apparatus of claim 1, further comprising means, intermediate the feed means and the registration means, for detecting overlapping documents.

23. The apparatus of claim 22, wherein the overlapping detection means is a light source and a corresponding electric eye receiver disposed on opposite sides of the document that sense a decrease in transmittance of light therebetween if two documents overlap each other such that if the light transmittance falls below a preselected level indicates the overlapping of two or more documents.

24. The apparatus of claim 1, further comprising means, intermediate the registration means and the data recording means, for triggering the data recording means to optically view each document.

25. The apparatus of claim 24, wherein the triggering means is an electronic eye electrically coupled to the data recording means.

26. The apparatus of claim 1, further comprising means, intermediate the feed means and the data recording means, for determining the width of the documents.

27. The apparatus of claim 26, wherein the width determination means is an electronic eye electrically coupled to the data recording means.

28. The apparatus of claim 15, further comprising means, adjacent each hopper, for sensing the approaching documents.

29. The apparatus of claim 28, wherein the approaching document sensing means is a pair of electronic eyes electronically coupled to the data collection means.

30. The apparatus of claim 15, further comprising a counting apparatus disposed in each hopper, wherein the counting device indicates the number of documents that have entered that hopper.

31. The apparatus of claim 6, wherein the registration belt is disposed at an angle relative to the longitudinal axis of the frame.

32. The apparatus of claim 31, further comprising an edge plate longitudinally extending adjacent the feed belt parallel to the frame, wherein the stripped document slides laterally downwardly toward the edge plate as it moves toward the data recording means on the registration belt so that the document eventually abuts the edge plate prior to reaching the data recording means.

33. The apparatus of claim 31, wherein the registration means further comprises a ball rack disposed elevationally above and parallel to the registration belt, the ball rack having a frame and a plurality of balls disposed in the same plane to be freely rotatable within the frame such that a portion of the balls extends below the frame and contacts the upper surface of each document moving on the registration belt, the ball rack ensuring that the bottom of the documents remains on the registration belt.

34. Apparatus for optically sorting a plurality of documents, comprising:

(a) a frame;

(b) means on the frame for feeding the documents from a first position to a second position having an entrance portion and an exit portion, wherein each document is separated from other documents such that a single document at a time passes through the exit portion of the feeding means to the second position;

(c) means for registering each document, located at the second position and having a front portion adjacent the exit portion of the feeding means and an opposite end portion, wherein the registration means aligns the documents to be sorted and creates a desired spacing between each document;

(d) means, downstream from and adjacent to the end portion of the registration means, for recording selected data from each document;

(e) means, adjacent the data recording means, for sorting the documents into a desired organization based upon the data processed on each of the documents by the data recording means;

(f) means for transferring data from the recording means to the sorting means, (g) means, adjacent the entrance portion of the feeding means, for loading the documents to be supplied to the feeding means, wherein the loading means comprises:

(i) a document tray having a document receiving surface having a top end and a lower end;

(ii) a gate means disposed intermediate the loading means and the feeding means for interrupting the flow of documents from the loading means to the feeding means; and (iii) a load belt adjacent the lower end of the document receiving surface, wherein the load belt moves a plurality of documents onto the entrance portion of the feeding means, whereby the gate means allows a desired quantity of documents to move onto the feeding means;

(h) means for controlling the movement of the load belt; and (i) means, connected to the controlling means, for detecting the quantity of documents on the entrance portion of the feeding means, wherein the controlling means starts the movement of the load belt which moves documents onto the feed means when the quantity of documents on the entrance portion of the feeding means reaches a first selected level, as detected by the detecting means, and wherein the controlling means stops the movement of the load belt when the quantity of documents on the entrance portion of the feeding means reaches a second selected level, as detected by the detecting means.

35. The apparatus of claim 34, wherein the feeding means comprises:

(a) a feed belt having a top surface upon which a stack documents is disposed, the feed belt movable at a first selected speed so that the lowermost document within the stack is moved toward the registration means;

(b) a feed wheel located downstream from the stack of documents and having an outer circumference in contact with the bottom of the lowermost document and adjacent the top surface of the feed belt, the outer circumference rotatable to strip sequentially the lowermost document and move it toward the registration means;

(c) a rotatable retarding wheel having an outer periphery disposed above and in registry with the outer circumference of the feed wheel, the outer periphery rotating to move the documents above the lowermost document in the stack in a direction opposite the registration means to enable only one document to be sequentially advanced toward the registration means at a time; and (d) power means for rotating the feed belt, the feed wheel, and the retarding wheel.

36. An apparatus for optically sorting a plurality of documents, comprising:

(a) a frame;

(b) means on the frame for feeding the documents from a first position to a second position having an entrance portion and an exit portion, wherein each document is separated from other documents such that a single document at a time passes through the exit portion of the feeding means to the second position;

(c) means for registering each document, located at the second position and having a front portion adjacent the exit portion of the feeding means and an opposite end portion, wherein the registration means aligns the documents to be sorted and creates a desired spacing between each document;

(d) means, downstream from and adjacent to the end portion of the registration means, for recording selected data from each document;

(e) means, adjacent the data recording means, for sorting the documents into a desired organization based upon the data processed on each of the documents by the data recording means, wherein the sorting means comprises:

(i) at least one advancing means having an entrance end adjacent the data recording means and an exit end such that the exit end of one advancing means is adjacent and longitudinally aligned with the entrance end of the next sequential advancing means;

(ii) power means to move the advancing means;

(iii) at least one segregating means, each segregating means disposed adjacent the exit end of each advancing means; and (iv) at least one hopper, each hopper disposed adjacent each segregating means, wherein each segregating means directs documents of a preselected category into the adjacent hopper that is designated for that category of document, whereby the documents are sorted, wherein the hoppers further comprise (a) a document receiving plate; and (b) means for vertically adjusting the level of the plate within the hopper, depending upon the quantity of documents on the plate, wherein the vertical adjusting means further comprises level detection means for determining the quantity of documents on the plate having an output that controls the vertical adjusting means, whereby the level detection means moves the plate downwardly when the quantity of documents reaches a first selected level as detected by the level detection means, stops the downward movement of the plate when the quantity of documents reaches a second selected level as detected by the level detection means, and moves the plate upwardly when documents are removed from the plate until the quantity of documents is at a third selected level as detected by the level detection means; and (f) means for transferring data from the recording means to the sorting means.

37. A method for optical sorting a plurality of documents, comprising the steps of:

(a) providing a stack of documents to be optically sorted, each document having a top surface and an opposed bottom surface;

(b) stripping the lowermost document from the bottom of the stack of documents using a feed wheel contacting the bottom surface and rotating in a first direction and a retarding wheel, in an opposed relationship to the feed wheel, contacting the top surface and rotating in a direction opposite the first direction;

(c) maintaining a separation between each stripped document;

(d) directing the separated documents to a first location;

(e) aligning the documents, prior to reaching a second location on a predetermined path; and (f) recording selected data from each document at the second location.

38. The method of claim 37, further comprising, after the recording step, the step of storing the data from each document.

39. The method of claim 37, further comprising, after the recording step, providing a visual output of the recorded data.

40. The method of claim 37, further comprising a photoelectric eye to trigger the recording step.

41. The method of claim 37, wherein the select location for each document is determined based on the recorded data.

42. The method of claim 37, further comprising the step of transferring the documents to a selected location.

* * * * *